US007322140B2

(12) United States Patent
Peery

(10) Patent No.: US 7,322,140 B2
(45) Date of Patent: Jan. 29, 2008

(54) FRAME ASSEMBLY

(76) Inventor: James Peery, 430 University Pl., Grosse Pointe, MI (US) 48230

( * ) Notice: Subject to any disclaimer, the term of this patent is extended or adjusted under 35 U.S.C. 154(b) by 252 days.

(21) Appl. No.: 11/066,821

(22) Filed: Feb. 25, 2005

(65) Prior Publication Data

US 2005/0183308 A1 Aug. 25, 2005

Related U.S. Application Data

(60) Provisional application No. 60/559,397, filed on Apr. 2, 2004, provisional application No. 60/547,622, filed on Feb. 25, 2004.

(51) Int. Cl.
*A47G 1/06* (2006.01)

(52) U.S. Cl. ..... 40/789; 40/786; 40/788

(58) Field of Classification Search ..... 40/780, 40/786–789, 610, 798, 799; 229/167
See application file for complete search history.

(56) References Cited

U.S. PATENT DOCUMENTS 905,850 A * 12/1908 Craig ..... 40/788
1,262,508 A * 4/1918 Kaufman ..... 40/789
1,323,086 A * 11/1919 Moore ..... 40/788
2,772,499 A * 12/1956 Ferrucci ..... 40/786
2,814,896 A * 12/1957 Gyo ..... 40/788
2,950,556 A * 8/1960 Larios ..... 40/788
4,738,041 A * 4/1988 Drueck, Jr. ..... 40/788
4,769,934 A * 9/1988 Dolce ..... 40/789
4,782,611 A * 11/1988 Papov ..... 40/788
4,870,766 A * 10/1989 Topping ..... 40/788
5,513,455 A * 5/1996 Walker ..... 40/788
2002/0144445 A1* 10/2002 Gomez del Campo Diaz Barrerio ..... 40/788

* cited by examiner

*Primary Examiner*—Jennifer H. Gay
*Assistant Examiner*—Ruth C. Rodriguez
(74) *Attorney, Agent, or Firm*—Howard & Howard Attorneys, P.C.

(57) ABSTRACT

A frame assembly for displaying a print is disclosed. The frame assembly comprises a mounting area having a front surface and a back surface and a plurality of sides. Each of the sides have an edge portion and corners disposed between next adjacent sides. The edge portion comprises a first flap foldable about a first crease toward the front surface and a second flap connected to the first flap and foldable about a second crease toward the front surface. A pair of outer tabs is connected to distal ends of each of the second flaps and are foldable about a corner crease such that the outer tabs of the next adjacent second flaps abut when folded. The mounting area defines a plurality of access holes disposed in the mounting area next adjacent the corners for allowing access to the abutting outer tabs from the back surface for securing the outer tabs together to create a beveled appearance.

26 Claims, 6 Drawing Sheets

FRAME ASSEMBLY

CROSS REFERENCE TO RELATED APPLICATION

This application claims the benefit of Provisional Application Ser. Nos. 60/547,622 and 60/559,397 filed Feb. 25, 2004 and Apr. 2, 2004, respectively.

BACKGROUND OF THE INVENTION

1. Field of the Invention

The subject invention relates to a frame assembly for displaying a print, and more specifically, to a frame assembly constructed from a single sheet of material for shipping and displaying artwork.

2. Description of the Prior Art

Traditionally, artists, art galleries, and consumers have placed works of art, art pieces, or prints in wooden, plastic, or metal frames, which add expense to the ownership of the artwork. Frames often enhance or embellish the artwork and protect the surfaces and corners of the artwork when in storage, on display, or being shipped. Frames also provide support for hanging or displaying the artwork and can make a purchase more attractive to a potential consumer. For many works, such as posters or other reproductions, the cost of the artwork is proportionally less than the cost of the frame. For example, a print that costs $10 may be displayed in a frame that costs $100. Therefore, an artist or consumer will spend more money for the frame than for the work being displayed. Since the frames are generally expensive and may not suit the consumer, the frame may dissuade a potential consumer from making the purchase even if the consumer likes the artwork. If the consumer does purchase the artwork, the purchaser will be hesitant to change the frame because it was so expensive. Therefore, the consumer is stuck having artwork with the frame that the consumer does not desire or that conflicts with the decor of the consumer's home.

Another disadvantage is that heavy wooden, plastic, and metal frames increase the weight, thereby increasing the cost of transporting and shipping the artwork. This is especially the case for artworks that are purchased via the Internet or other mail order sales operations. The increased weight may increase the cost of shipping to or beyond the cost of the artwork itself. Additionally, transporting and shipping artworks generally requires additional packaging material, such as padding, due to the fragile nature of the artwork or print. Therefore, additional effort is required to protect the artwork by transporting and shipping the artwork in large and bulky containers. Typically, these containers must be destroyed in order to access the artwork. Re-useable containers are available, however, these types of containers are particularly expensive.

For these reasons, retailers may choose to mount the artwork on a cardboard backing with a clear plastic wrapping. While this method reduces costs to the retailer, the additional steps of mounting the artwork and covering the artwork in plastic are time consuming and often require special equipment. Further, the cardboard backing provides little or no protection to the artwork during shipping or transportation.

Still other cardboard frames are known to those skilled in the art. These cardboard frames are generally formed from a sheet of material having flaps and tabs that are folded to form a three-dimensional appearance. The flaps of the material include overlapping sections that may include an adhesive, such as glue, for holding the folded material in place. Alternatively, a fastener may be inserted through the flaps prior to folding to hold the flaps in position. Once the flaps are secure, the tabs are inserted into apertures to form a three-dimensional appearance and to hold the folded material in place. One disadvantage of such an assembly is that the cardboard frames are less sturdy and do not provide sufficient support during transportation and shipping. Further, these cardboard frames do not adequately protect the artwork because the tabs or the adhesive do not provide sufficient fastening to withstand the forces occurring during transportation and shipping.

These related art frame assemblies are characterized by one or more inadequacies. Specifically, these assemblies are expensive to manufacture and are disproportionally expensive compared to the artwork being displayed. Further, the frames are generally heavy and increase the cost of shipping and transporting the artwork. If lesser frames are used, like the related art cardboard frames, then the artwork is not protected and may be damaged during shipping and transportation. Therefore, it would be advantageous to provide a frame assembly that overcomes these disadvantages.

SUMMARY OF THE INVENTION AND ADVANTAGES

The subject invention provides a frame assembly for displaying a print. The frame assembly comprises a mounting area having a front surface and a back surface and a plurality of sides. Each of the sides have an edge portion and have corners disposed between next adjacent sides. The edge portion comprises a first flap and a second flap. The first flap is connected to the side and foldable about a first crease toward the front surface. The second flap is connected to the first flap and foldable about a second crease toward the front surface. A pair of outer tabs is connected to distal ends of each of the second flaps. The outer tabs are foldable about a corner crease such that the outer tabs of the next adjacent second flaps abut when folded about the second crease and the corner crease. The mounting area defines a plurality of access holes disposed in the mounting area next adjacent the corners for allowing access to the abutting outer tabs from the back surface for securing the outer tabs together to create a beveled appearance of the frame assembly.

The subject invention overcomes the inadequacies that characterize the related art assemblies. Specifically, the frame assembly is inexpensive to manufacture and is easy to store prior to assembling the frame assembly. The frame assembly does not require additional machinery since the frame assembly is quickly and easily assembled through folding and basic stapling. Further, the frame assembly is attractive for retail sales and is ready for display. The frame assembly is also sufficiently sturdy to offer robust protection to the artwork, such that the frame assembly can be inserted into a shipping box without additional packaging. Finally, the frame assembly is lightweight, thereby reducing shipping costs significantly.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
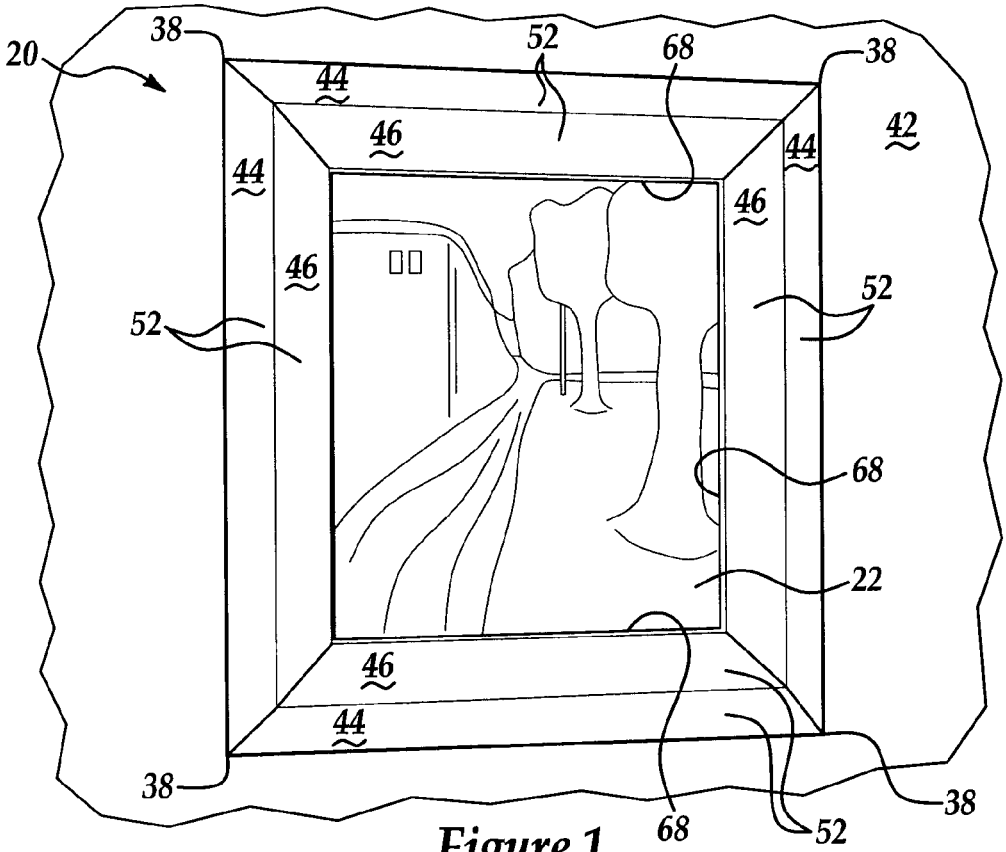
FIG. 1 is a perspective front view of a frame assembly according to the subject invention having a print displayed therein.

Referring to the Figures, wherein like numerals indicate corresponding parts throughout the several views, a frame assembly for displaying a print 22 is shown generally at 20 in FIG. 1. The frame assembly 20 is illustrated in an assembled form in FIGS. 1 and 2. The frame assembly 20 provides a three-dimensional appearance, which is preferably beveled. The beveled appearance is semi-permanent and is aesthetically appealing to allow the frame assembly 20 to be used to display the artwork while being sold or permanently thereafter without significantly increasing the cost. The frame assembly 20 is sufficiently sturdy to protect the print 22 during shipping and transporting the frame assembly 20 without additional packaging material. The print 22 may include an original artwork or art piece, a card, a poster, or the like. The artwork may be on canvas, sheet stock, paper, or the like. More preferably, the print 22 is a digital replication of artwork that may be printed on the canvas.

Figure 2:
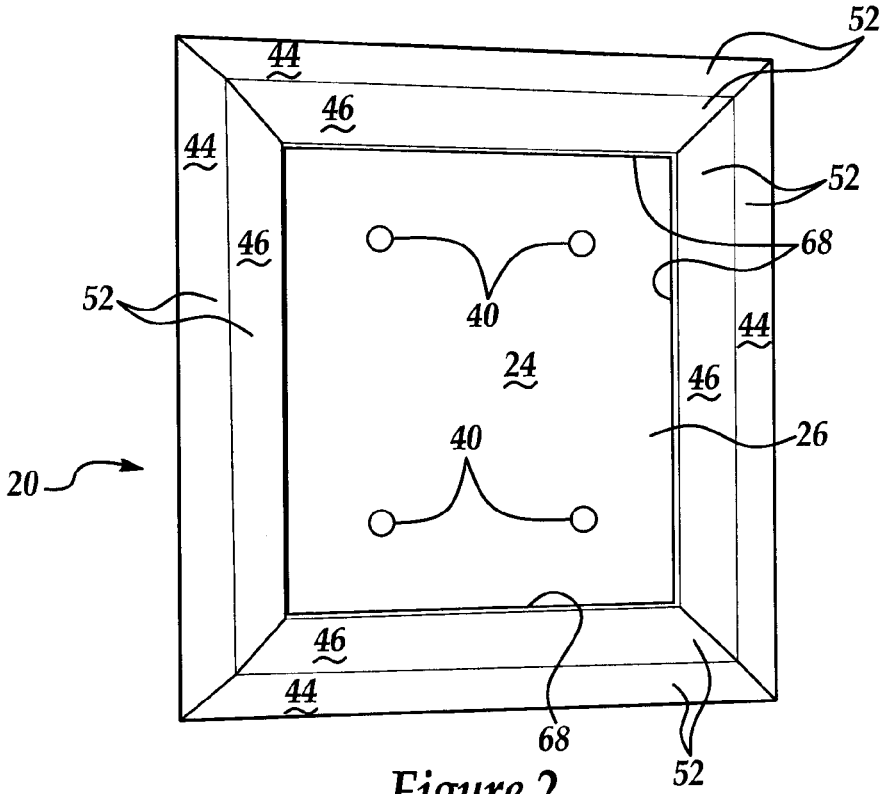
FIG. 2 is a perspective front view of the frame assembly in an assembled form and having the print removed therefrom.
Figure 3:
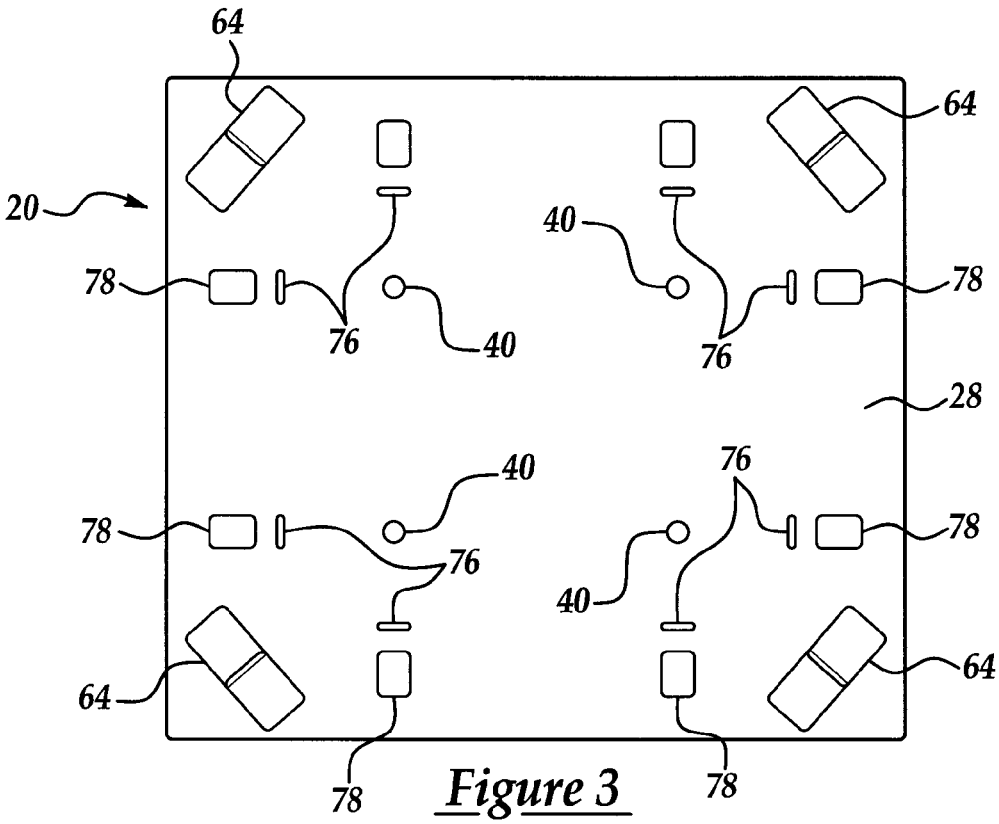
FIG. 3 is rear view of the frame assembly in an assembled form.
Figure 4:
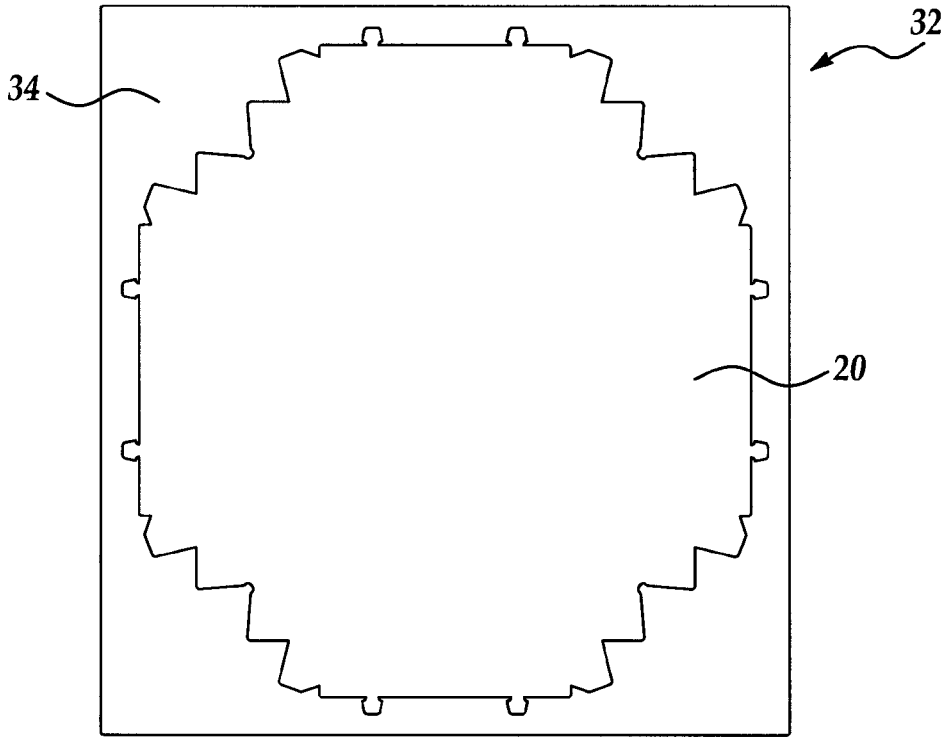
FIG. 4 is a front view of a sheet of material for forming the frame assembly in a first embodiment.

Referring to FIG. 2, a perspective front view of the frame assembly 20 is illustrated in the assembled form with the print 22 being removed. FIG. 3 illustrates a rear view of the frame assembly 20 in the assembled form. The frame assembly 20 generally includes a mounting area 24 having a front surface 26, a back surface 28, and a plurality of sides 30. The frame assembly 20, in a first embodiment, is preferably constructed from a single sheet of continuous material 32 as illustrated in FIG. 4. The sheet of material 32 has an outer edge 34 that is discarded to form the frame assembly 20. The frame assembly 20 is illustrated as being formed from a four-sided, generally rectangular sheet of material; however, the sheet of material 32 may have three, five, or more sides to form the frame assembly 20.

The mounting area 24 is preferably centrally located in the sheet of material 32 and each of the sides 30 of the mounting area 24 has an edge portion with a corner 38 disposed between next adjacent sides 30. The edge portions are shown generally at 36 in FIGS. 4 and 5. As an example, the four-sided sheet of material 32 has four edge portions 36 and four corners 38 with the mounting area 24 therebetween. The mounting area 24 is generally flat and free of obstructions such that the print 22 displayed therein will lay flat. More preferably, the mounting area 24 and the edge portions 36 are integrally formed from the continuous sheet of material 32.

Figure 5:
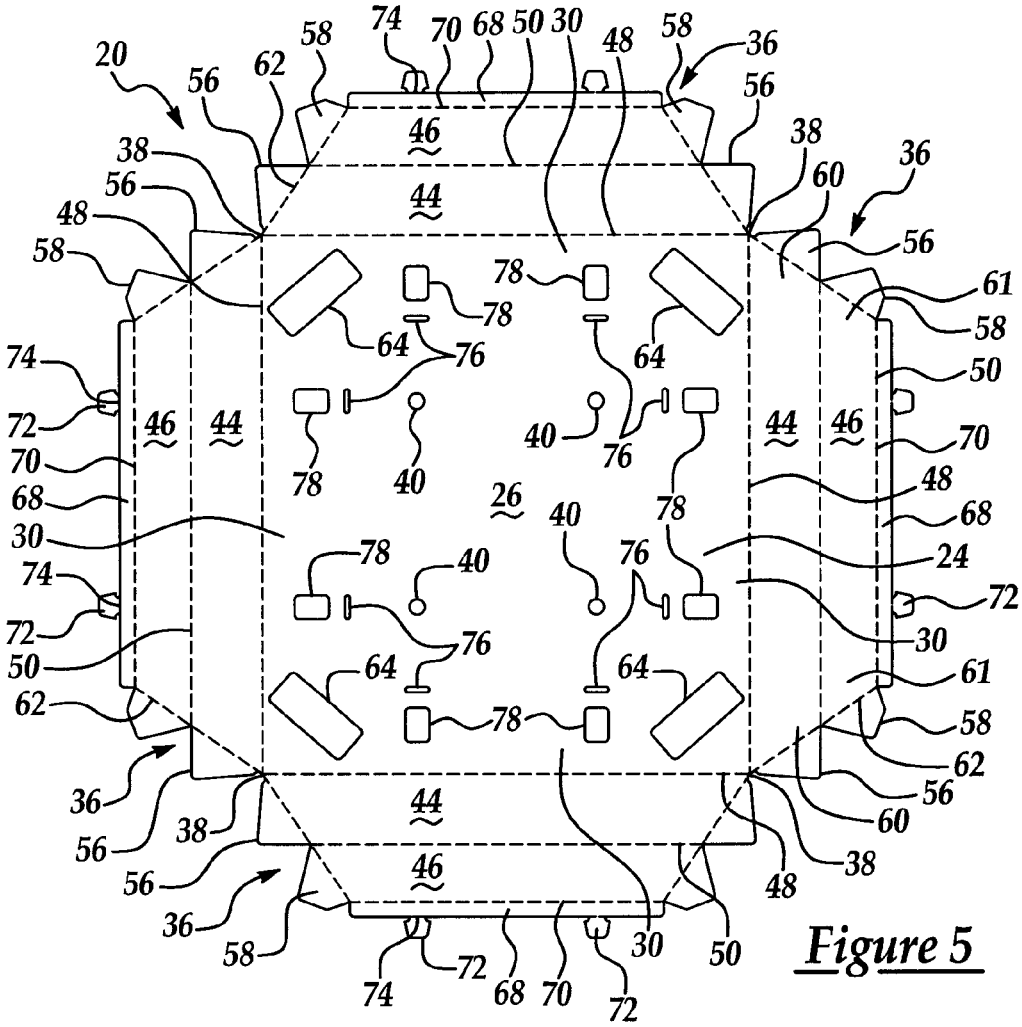
FIG. 5 is a front view of the first embodiment of the frame assembly in an unassembled form.

Referring to FIG. 5, the mounting area 24 further defines a plurality of mounting holes 40 for mounting the frame assembly 20 on a wall 42. The mounting holes 40 are preferably positioned between the edge portions 36 when folded such that the mounting holes 40 are accessible from the front surface 26. The mounting holes 40 may be punched from the sheet of material 32 during forming or may be cutout after the sheet of material 32 has been formed. The mounting holes 40 allow for a hanging wire (not shown) or similar type of hanging device to be inserted through the mounting holes 40 for hanging the frame assembly 20. Is to be appreciated that the mounting holes 40 could be eliminated and replaced with other hanging structures known to those skilled in the art, such as a metal bar, mounted to the back surface 28 without deviating from the subject invention. For the four-sided sheet of material 32, there are four mounting holes 40 for hanging the frame assembly 20 either in a vertical or a horizontal orientation. The number of mounting holes 40 depends on the shape of the frame assembly 20 and the desired orientation.

Each of the edge portions 36 comprise a first flap 44 connected to the side 30 and a second flap 46 connected to the first flap 44. The first flap 44 is foldable about a first crease 48 toward the front surface 26 and the second flap 46 is foldable about a second crease 50 toward the front surface 26. Both the first and the second flaps 44, 46 have an exposed surface 52 and an unexposed surface 54. The exposed surface 52 is visible when the frame assembly 20 is in the folded form and the unexposed surface 54 is not visible. The exposed surface 52 may be printed or colored to alter the appearance of the frame assembly 20 or to coordinate the frame assembly 20 to a particular decor. Preferably, the exposed surface 52 is altered during manufacture of the sheet of material 32; however, the exposed surface 52 may be altered after the frame assembly 20 is assembled.

Figure 6:
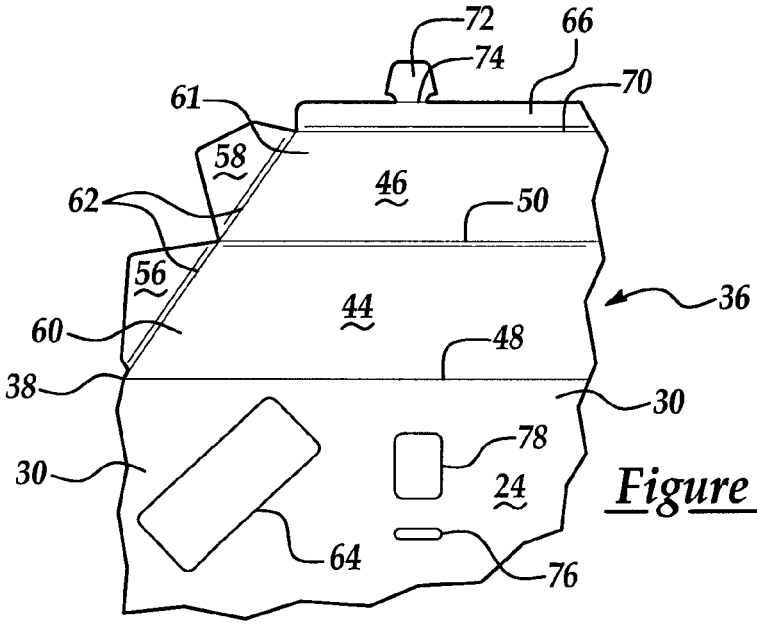
FIG. 6 is a front view of the frame assembly having a mounting area and an edge portion with a first flap and a second flap having an inner tab and an outer tab in an unfolded position.

In the first embodiment, the frame assembly 20 includes a pair of inner tabs 56 and a pair of outer tabs 58. The pair of inner tabs 56 is connected to distal ends 60 of the first flaps 44. Said another way, the first flap 44 has one inner tab 56 at one end and the other inner tab 56 at the other end. The pair of outer tabs 58 is connected to distal ends 61 of the second flaps 46, similar to that of the inner tabs 56 and the first flaps 44. The inner tabs 56 and the outer tabs 58 are each foldable about a corner crease 62. The inner tabs 56 of the next adjacent first flap 44 abut when the first flap 44 is folded about the first crease 48 and the inner tab 56 is folded about the corner crease 62. Likewise, the outer tabs 58 of the next adjacent second flaps 46 abut when the second flap 46 is folded about the second crease 50 and the outer tab 58 is folded about the corner crease 62. In the first embodiment, the outer tabs 58 are illustrated as substantially quadrilateral-shaped and the inner tabs 56 are illustrated as substantially triangular-shaped. The outer tabs 58 and the inner tabs 56 may be any shape so long the inner and outer tabs 56, 58 abut when folded, respectively. FIG. 6 illustrates one end of the first flap 44 and the second flap 46 having the inner tab 56 and the outer tab 58 folded.

Figure 7:
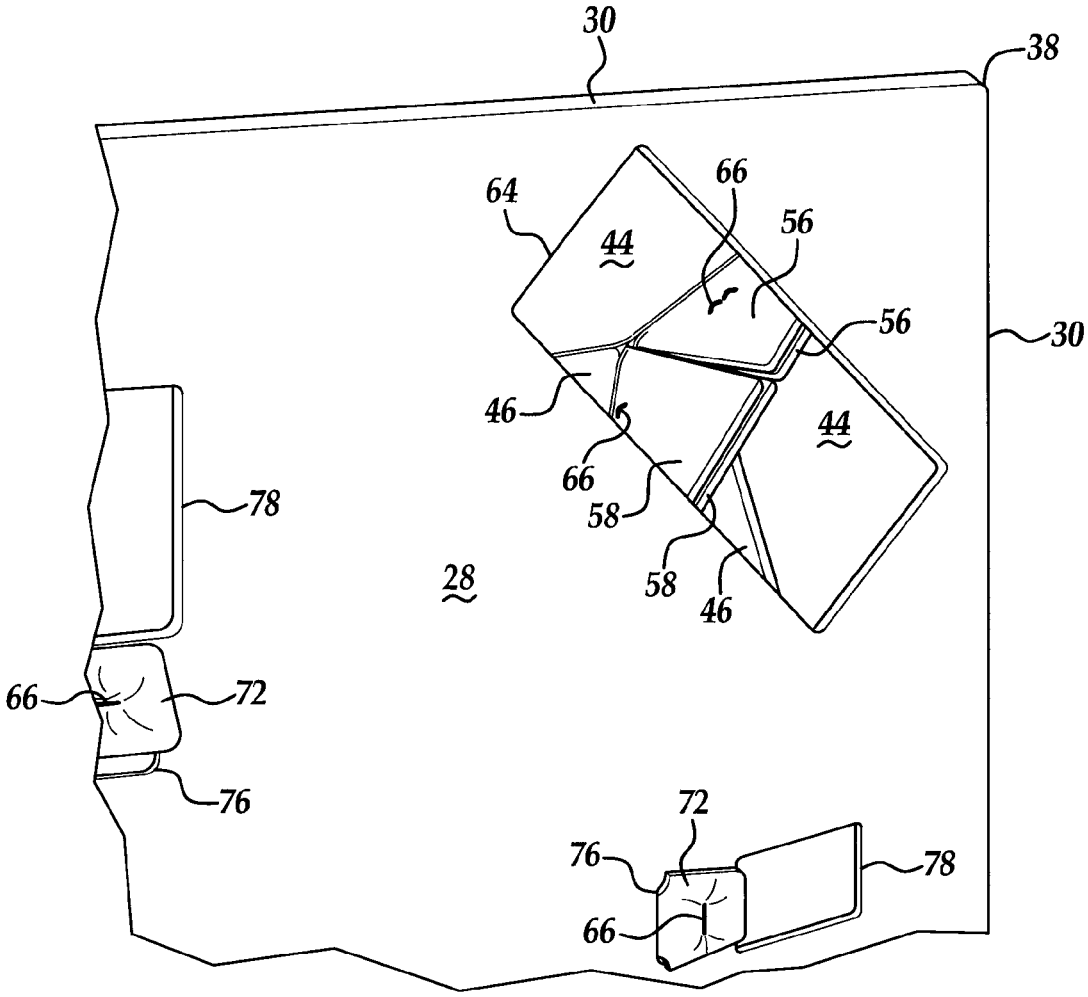
FIG. 7 is a partial perspective view from a back surface of the mounting area illustrating the abutment of the inner and outer tabs respectively.

In order to secure the abutting inner and outer tabs 56, 58, the mounting area 24 defines a plurality of access holes 64 next adjacent the corners 38 for allowing access to the abutting outer tabs 58 from the back surface 28. The inner and outer tabs 56, 58 are secured to create a beveled appearance of the frame assembly 20 and to provide support and protection to the print 22. The access holes 64 may be punched while the sheet of material 32 is formed or cutout after the sheet of material 32 has been formed. With reference to FIG. 7, a partial perspective view of the frame assembly 20 is illustrated through one of the access holes 64. Through the access hole 64, it can be seen that the abutting inner tabs 56 of next adjacent first flaps 44 have been fastened together and the abutting outer tabs 58 of next adjacent second flaps 46 have also been fastened together. The inner and outer tabs 56, 58 are fastened with a fastener 66, such as a staple, a rivet, or the like. Referring back to FIG. 2, the plurality of the access holes 64 are preferably hidden beneath the edge portion 36 when folded for providing the mounting area 24 substantially free of obstructions. Since the access holes 64 are disposed beneath the edge portion 36, the access holes 64 are required to gain access to the abutting inner and outer tabs 56, 58.

After the inner and outer tabs 56, 58 have been fastened, the edge portion 36 must be secured in the folded position. Referring again to FIG. 4, the frame assembly 20 includes a fillet flap 68 connected to the second flap 46. The fillet flap 68 is foldable about a third crease 70 toward the front surface 26. Each of the fillet flaps 68 have at least one fillet tab 72 extending therefrom that is foldable about a fillet crease 74 for securing the edge portion 36 to the mounting area 24 when folded. The fillet flap 68 allows the frame assembly 20 to provide sufficient depth to properly display the print 22. However, the fillet flap 68 may be omitted and the fillet tabs 72 would then mount directly to the second flap 46. Preferably, the fillet tab 72 is proximally located on the fillet flap 68 and more preferably there are multiple fillet tabs 72 for securing to the mounting area 24.

Figure 8:
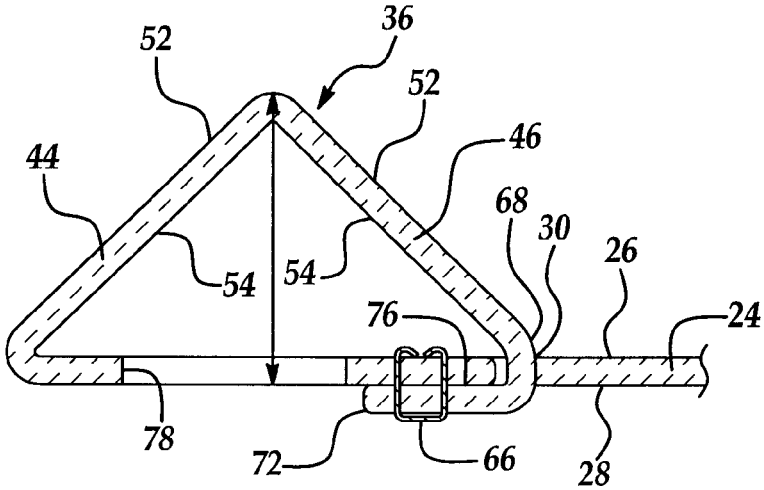
FIG. 8 is a partial cross-sectional view of a fillet tab fastened to a back surface for securing the edge portion in a folded position.

The mounting area 24 further includes a plurality of fillet tab apertures 76 disposed in the mounting area 24 for receiving the fillet tab 72 and a plurality of locking holes 78 each disposed adjacent the fillet tab apertures 76. The locking holes 78 allow for folding the fillet tab 72 into contact with the mounting area 24 and for securing the fillet tab 72 thereto from the back surface 28 with a fastener 66. The fillet tab apertures 76 and the locking holes 78 may be punched while the sheet of material 32 is formed or cutout after the sheet of material 32 has been formed. FIG. 8 is a cross-sectional view of the fillet tab 72 having been inserted through the fillet tab apertures 76 and folded into contact with the back surface 28. The locking hole 78 allows access for securing the fillet tab 72 with the fastener 66. The fastener 66 illustrated in FIG. 8 is a staple and is preferably inserted into the fillet tab 72 by a pliers-type staple gun. Referring back to FIG. 2, it is preferable that the plurality of locking holes 78 are hidden beneath the edge portion 36 when folded for providing the mounting area 24 substantially free of obstructions.

In operation, the inner tabs 56 on each of the first flaps 44 are folded inwardly about the corner crease 62. Next, each of the first flaps 44 is folded about the first crease 48 inwards toward the front surface 26. By folding each of the first flaps 44, the folded inner tabs 56 are brought into abutting engagement with adjacent inner tabs 56. A fastening device (not shown) is inserted through each of the access holes 64 and the fastener 66 is inserted through each set of inner tabs 56 that are in abutting engagement. The outer tabs 58 on each of the second flaps 46 are then folded inwardly about the corner crease 62. Then, each of the second flaps 46 is folded about the second crease 50 inwards toward the front surface 26. Again, folding the second flaps 46 brings the folded outer tabs 58 into abutting engagement with adjacent outer tabs 58. The fastening device is again inserted through each of the access holes 64 and the fastener 66 is inserted through each set of outer tabs 58 that are in abutting engagement.

The fastening of the inner and outer tabs 56, 58 creates the beveled surface of the frame assembly 20. However, in order to secure the beveled surface, the fillet flap 68 is folded inwardly about the third crease 70 and the fillet tabs 72 are inserted through the fillet tab aperture 76. Next, the fillet tab 72 is folded about the fillet crease 74 into contact with the back surface 28. The fastening device is inserted through the locking hole 78 and the fastener 66 is inserted through the back surface 28 and the fillet tab 72.

Figure 9:
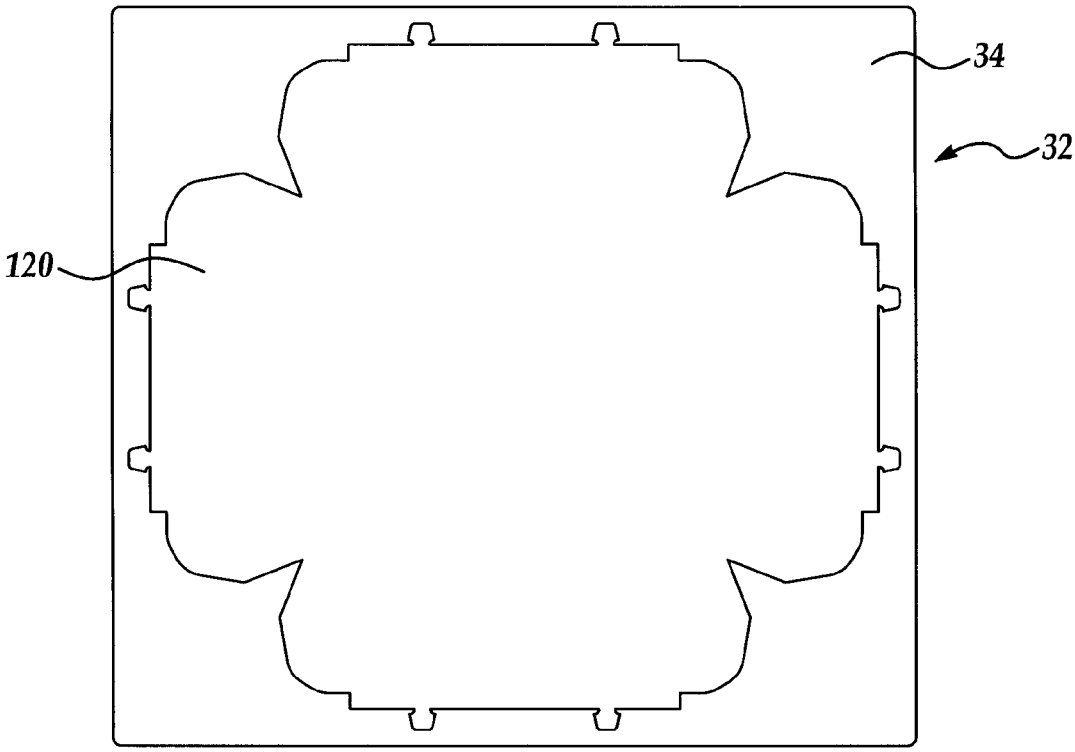
FIG. 9 is a front view of a second embodiment of a sheet of material for forming the frame assembly according to the subject invention.
Figure 10:
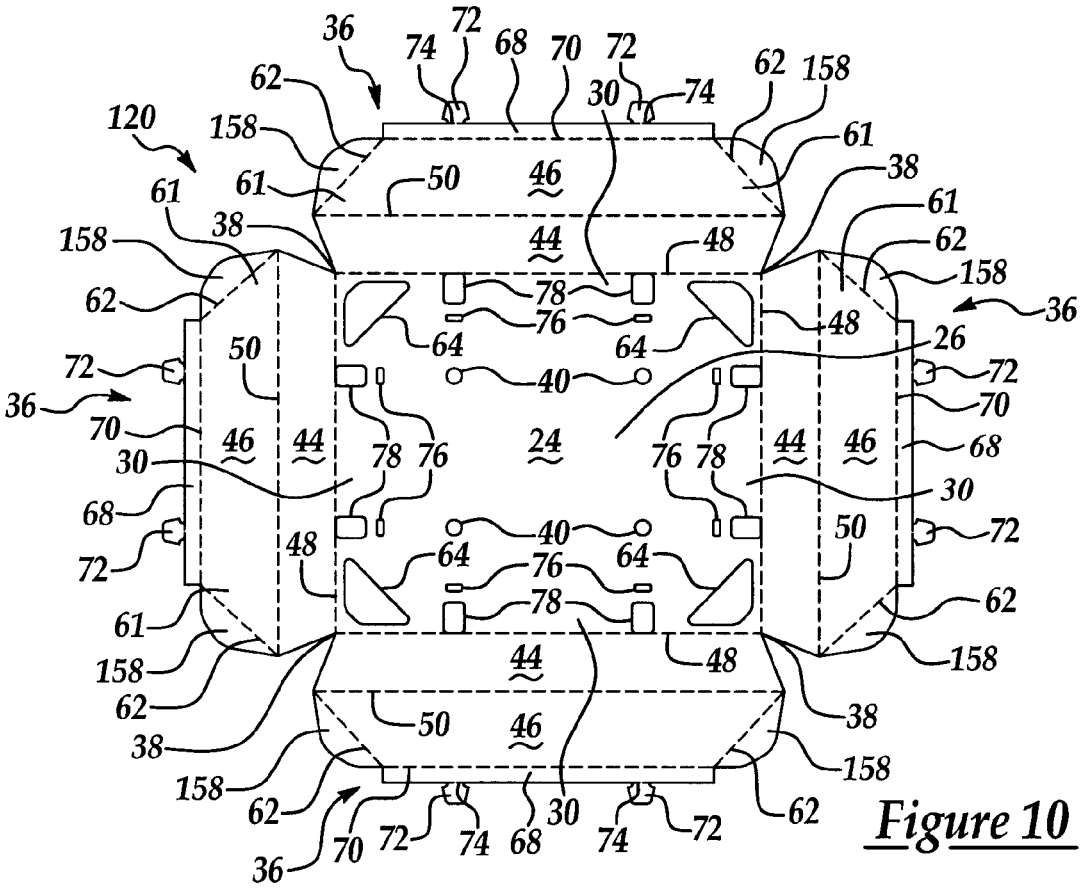
FIG. 10 is a front view of the second embodiment of the frame assembly in an unassembled form.
Figure 11:
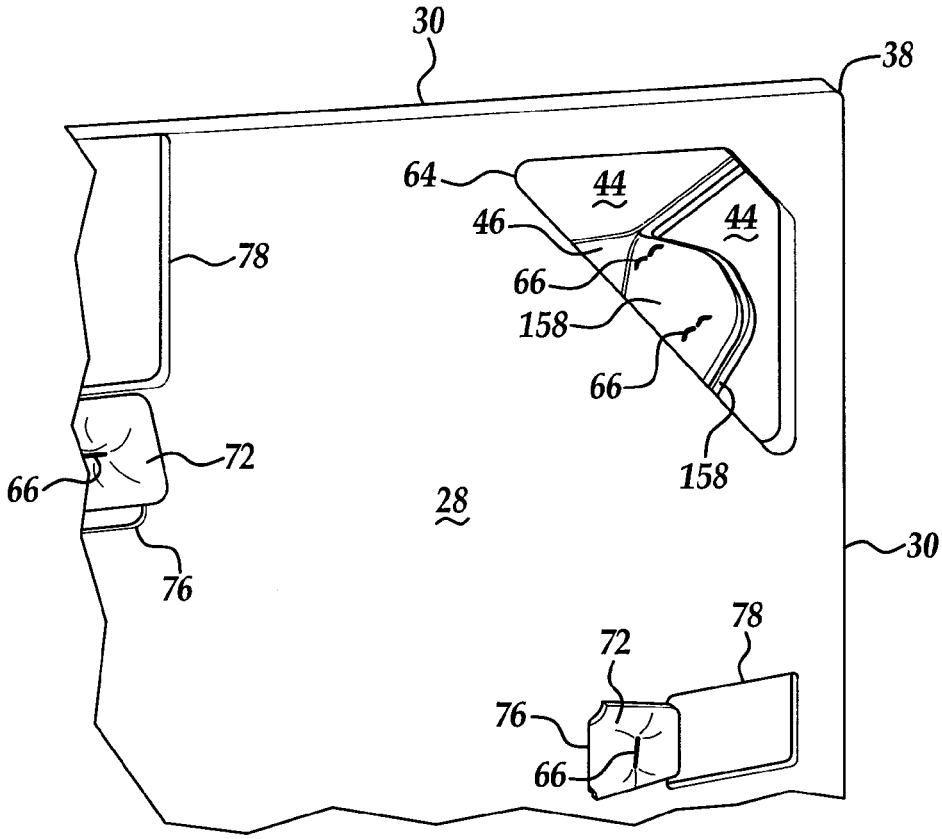
FIG. 11 is a partial perspective view of the abutment of the outer tabs in the second embodiment.

Referring to FIGS. 9 to 11, a second embodiment of a frame assembly 120 is illustrated. The second embodiment, in the assembled form, is substantially similar as the first embodiment shown in FIGS. 1 and 2. However, the second embodiment does not include the pair of inner tabs 56 disposed on the first flap 44, but only includes a pair of outer tabs 158 connected to each of the second flaps 46. The other features of the second embodiment are similar to those described above in relation to the first embodiment. The outer tabs 158 are illustrated as substantially arc-shaped.

In operation, each of the first flaps 44 is folded about the first crease 48 inwards toward the front surface 26. The outer tabs 158 on each of the second flaps 46 are then folded inwardly about the corner crease 62. Then, each of the second flaps 46 is folded about the second crease 50 inwards toward the front surface 26. Folding the second flaps 46 brings the folded outer tabs 158 into abutting engagement with adjacent outer tabs 158. The fastening device is inserted through each of the access holes 64 and the fastener 66 is inserted through each set of outer tabs 158 that are in abutting engagement.

The fastening of the outer tabs 158 creates the beveled surface of the frame assembly 120. However, in order to secure the beveled surface, the fillet flap 68 is folded inwardly about the third crease 70 and the fillet tabs 72 are inserted through the fillet tab aperture 76. Next, the fillet tab 72 is folded about the fillet crease 74 into contact with the back surface 28. The fastening device is inserted through the locking hole 78 and the fastener 66 is inserted through the back surface 28 and the fillet tab 72.

Figure 12:
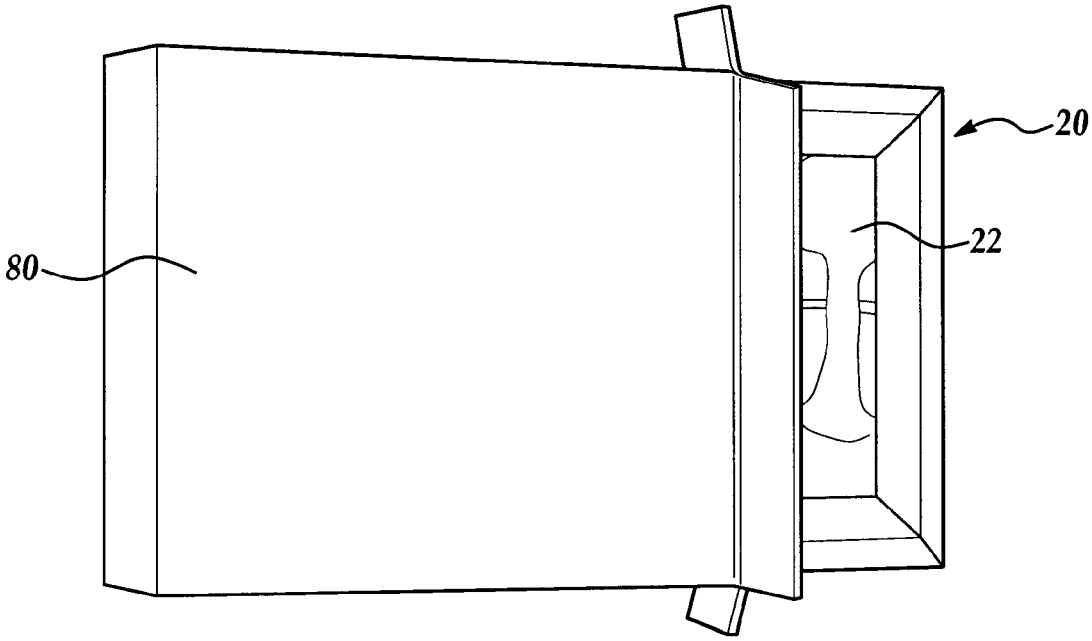
FIG. 12 is a perspective view of the frame assembly being inserted into a shipping container for transportation.

Referring to FIG. 12, the frame assembly 20 is illustrated being packaged for transportation in a box 80. Both of the above embodiments are particularly suited for quick, efficient, and inexpensive shipping and transportation. One reason for this advantage is that the edge portions 36 have a height sufficient for contacting the box 80 and for providing support when folded. Additionally, since the frame assembly 20 is able to be secured with the fasteners 66 in the folded position, the frame assembly 20 is sufficiently sturdy to package in the box 80 without any additional packaging material 32. Therefore, the cost of shipping and transporting the subject invention will be reduced because of the reduced weight. Further, the cost will be reduced because the labor required to package the frame assembly 20 is substantially eliminated.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A frame assembly for displaying a print, said frame assembly comprising:

a mounting area having a front surface and a back surface and a plurality of sides;

each of said sides having an edge portion and having corners disposed between next adjacent sides;

said edge portion comprising a first flap connected to said side and foldable about a first crease toward said front surface, a second flap connected to said first flap and foldable about a second crease toward said front surface;

a pair of outer tabs connected to distal ends of said second flaps and foldable about a corner crease such that said outer tabs of said next adjacent second flaps abut when folded about said second crease and said corner crease wherein said mounting area defines a plurality of access holes disposed in said mounting area next adjacent said corners to access said abutting outer tabs from said back surface for securing said outer tabs together presenting a beveled appearance of said frame assembly; and said abutting outer tabs disposed within said edge portion without extending through said back surface when said abutting outer tabs are secured to one another.

2. A frame assembly as set forth in claim 1 wherein said plurality of said access holes are further defined as being hidden beneath said edge portion when folded for providing said mounting area substantially free of obstructions.

3. A frame assembly as set forth in claim 1 further comprising a fillet flap connected to said second flap and foldable about a third crease toward said front surface.

4. A frame assembly as set forth in claim 3 wherein each of said fillet flaps further comprises at least one fillet tab extending therefrom and foldable about a fillet crease for securing said edge portion to said mounting area when folded.

5. A frame assembly as set forth in claim 4 wherein said mounting area further defines a plurality of fillet tab apertures disposed in said mounting area for receiving said fillet tab.

6. A frame assembly as set forth in claim 5 wherein said mounting area further defines a plurality of locking holes each disposed adjacent said fillet tab apertures for folding said fillet tab into contact with said mounting area and for securing said fillet tab thereto from said back surface with a fastener.

7. A frame assembly as set forth in claim 6 wherein said plurality of locking holes are further defined as being hidden beneath said edge portion when folded for providing said mounting area substantially free of obstructions.

8. A frame assembly as set forth in claim 1 further comprising a pair of inner tabs connected to distal ends of said first flaps and foldable about said corner crease such that said inner tabs of said next adjacent first flaps abut when folded about said first crease and said corner crease and disposed within said edge portion when folded.

9. A frame assembly as set forth in claim 8 further comprising a plurality of fasteners securing said abutting inner tabs to one another and to hold said edge portion for creating said beveled appearance of said frame assembly.

10. A frame assembly as set forth in claim 1 further comprising a plurality of fasteners securing said abutting outer tabs to one another and to hold said edge portion for creating said beveled appearance of said frame assembly.

11. A frame assembly as set forth in claim 1 wherein said mounting area further defines a plurality of mounting holes for mounting said frame assembly on a wall.

12. A frame assembly as set forth in claim 11 wherein said mounting holes are further defined as being positioned between said edge portions when folded such that said mounting holes are accessible from said front surface when said edge portions are folded.

13. A frame assembly as set forth in claim 1 wherein said mounting area and said edge portions are further defined as integrally formed from a continuous sheet of material.

14. A frame assembly as set forth in claim 1 wherein said outer tab is further defined as substantially arc-shaped.

15. A frame assembly for displaying a print, said frame assembly comprising:

a mounting area having a front surface and a back surface and a plurality of sides;

each of said sides having an edge portion and having corners disposed between next adjacent sides;

said edge portion comprising a first flap connected to said side and foldable about a first crease toward said front surface, a second flap connected to said first flap and foldable about a second crease toward said front surface, and a fillet flap connected to said second flap and foldable about a third crease toward said front surface;

a pair of inner tabs connected to distal ends said first flaps and foldable about a corner crease such that said inner tabs of said next adjacent first flaps abut when folded about said first crease and said corner;

a pair of outer tabs connected to distal ends said second flaps and foldable about said corner crease such that said outer tabs of said next adjacent second flaps abut when folded about said second crease and said corner crease;

wherein said mounting area defines a plurality of access holes disposed in said mounting area next adjacent said corners to access said abutting inner and outer tabs from said back surface for securing said inner and outer tabs together presenting a beveled appearance of said frame assembly;

said inner and outer tabs disposed within said edge portion without extending through said back surface when said abutting inner and outer tabs are secured to one another, respectively.

16. A frame assembly as set forth in claim 15 wherein said plurality of said access holes are further defined as being hidden beneath said edge portion when folded for providing said mounting area substantially free of obstructions.

17. A frame assembly as set forth in claim 15 wherein each of said fillet flaps further comprises at least one fillet tab extending proximally therefrom and foldable about a fillet crease for securing said edge portion to said mounting area when folded.

18. A frame assembly as set forth in claim 17 wherein said mounting area further defines a plurality of fillet tab apertures disposed in said mounting area for receiving said fillet tab.

19. A frame assembly as set forth in claim 18 wherein said mounting area further defines a plurality of locking holes each disposed adjacent said fillet tab apertures for folding said fillet tab into contact with said mounting area and for securing said fillet tab thereto from said back surface with a fastener.

20. A frame assembly as set forth in claim 19 wherein said plurality of locking holes are further defined as being hidden beneath said edge portion when folded for providing said mounting area substantially free of obstructions.

21. A frame assembly as set forth in claim 15 wherein said mounting area further defines a plurality of mounting holes for mounting said frame assembly on a wall.

22. A frame assembly as set forth in claim 21 wherein said mounting holes are further defined as being positioned between said edge portions when folded such that said mounting holes are accessible from said front surface when said edge portions are folded.

23. A frame assembly as set forth in claim 15 wherein said mounting area and said edge portions are further defined as integrally formed from a continuous sheet of material.

24. A frame assembly as set forth in claim 15 wherein said outer tab is further defined as substantially quadrilateral-shaped.

25. A frame assembly as set forth in claim 15 wherein said inner tab is further defined as substantially triangular-shaped.

26. A frame assembly as set forth in claim 15 wherein said edge portions are further defined as having a height sufficient for transporting said frame assembly when folded.

* * * * *

UNITED STATES PATENT AND TRADEMARK OFFICE

CERTIFICATE OF CORRECTION

PATENT NO. : 7,322,140 B2
APPLICATION NO. : 11/066821
DATED : January 29, 2008
INVENTOR(S) : James Peery It is certified that error appears in the above-identified patent and that said Letters Patent is hereby corrected as shown below:

Column 8, line 37, claim 15, please insert -- crease -- between “corner” and “;”

Signed and Sealed this

Twenty-seventh Day of May, 2008

JON W. DUDAS
*Director of the United States Patent and Trademark Office*